US005649272A

United States Patent [19]

Kwon

[11] Patent Number: 5,649,272

[45] Date of Patent: Jul. 15, 1997

[54] DEVELOPING CARTRIDGE AND IMAGE FORMING APPARATUS HAVING THE SAME

[75] Inventor: Young-Jun Kwon, Suwon, Rep. of Korea

[73] Assignee: SamSung Electronics Co., Ltd., Suwon, Rep. of Korea

[21] Appl. No.: 551,816

[22] Filed: Nov. 7, 1995

[30] Foreign Application Priority Data

Nov. 8, 1994 [KR] Rep. of Korea ..... 29178/1994

[51] Int. Cl.[6] ..... G03G 15/16

[52] U.S. Cl. ..... 399/318; 399/297

[58] Field of Search ..... 355/200, 210, 355/245, 260, 271, 277; 399/119, 66, 297, 318, 121

[56] References Cited

U.S. PATENT DOCUMENTS

| | | | |
|---|---|---|---|
| 4,903,081 | 2/1990 | Takahashi . | |
| 5,103,261 | 4/1992 | Matsuo et al. | 355/210 |
| 5,146,270 | 9/1992 | Matsuo et al. | 355/200 |
| 5,233,395 | 8/1993 | Kohyama . | |
| 5,249,022 | 9/1993 | Watanabe et al. . | |
| 5,335,053 | 8/1994 | Hasegawa . | |
| 5,406,355 | 4/1995 | Komuro et al. | 355/210 |
| 5,410,390 | 4/1995 | Miura et al. . | |
| 5,428,429 | 6/1995 | Fletcher . | |
| 5,450,159 | 9/1995 | Choi et al. | 355/200 |

*Primary Examiner*—Sandra L. Brase
*Attorney, Agent, or Firm*—Robert E. Bushnell, Esq.

[57] ABSTRACT

A developing cartridge and an image forming apparatus utilizing the developing cartridge are provided. The developing cartridge includes a frame, a photosensitive drum which is rotatably installed upon the frame, a developing unit for developing an electrostatic latent image formed on the outer surface of the photosensitive drum, and a transfer unit having a brush with fibers for transferring a toner image from the outer surface of the photosensitive drum onto paper, a voltage unit for selectively applying a predetermined positive or negative voltage to the brush, and a rotary unit for enabling the fibers of the brush to engage the outer surface of the photosensitive drum after the developing cartridge is fully installed within the image forming apparatus.

21 Claims, 4 Drawing Sheets

DEVELOPING CARTRIDGE AND IMAGE FORMING APPARATUS HAVING THE SAME

CROSS-REFERENCE TO RELATED APPLICATIONS

This application makes reference to, incorporates the same herein, and claims all benefits accruing under 35 U.S.C. §119 from an application for *Developing Cartridge And Image Forming Apparatus Having The Same* earlier filed in the Korean Industrial Property Office on Nov. 8, 1994 and there assigned Ser. No. 29178/1994.

BACKGROUND OF THE INVENTION

The present invention relates to an image forming apparatus using electrophotography, and more particularly, to a developing cartridge for an image forming apparatus in which a photosensitive drum, a developing unit, and a transfer unit for transferring toner from the photosensitive drum to paper are combined into a unitary structure.

With the image forming apparatus using electrophotograph in which a toner image developed from an electrostatic latent image is transferred onto paper, charging, exposing, developing, transferring and cleaning operations are performed. Image quality ultimately depends on the preciseness of each of these operations. Of particular importance is the operation of transferring the toner from the outer surface of a photosensitive member to the paper. A conventional transfer unit for an image forming apparatus is disclosed in U.S. Pat. No. 4,903,081 issued to Takahashi. The present invention seeks to provide a developing cartridge for an image forming apparatus that increases the reliability of the transfer operation over that provided by Takahashi '081.

SUMMARY OF THE INVENTION

Accordingly, it is an object of the present invention to provide an improved developing cartridge for an image forming apparatus.

It is another object to provide a developing cartridge for an image forming apparatus that can be easily installed within the image forming apparatus.

It is still another object to provide a developing cartridge for an image forming apparatus that combines a photosensitive dram, a developing unit and a transfer unit as a unitary structure.

It is yet another object to provide a developing cartridge for an image forming apparatus that increases the reliability of a toner transfer operation wherein toner from the outer surface of a photosensitive drum is transferred to paper.

It is still yet another object to provide a developing cartridge for an image forming apparatus having a transfer unit that uses a fibrous brush to transfer toner from the outer surface of the photosensitive drum onto paper.

It is a further object to provide a developing cartridge for an image forming apparatus wherein fibers from the brush of the transfer unit are moved into contact with the outer surface of the photosensitive drum in response to the developing cartridge being fully installed within the image forming apparatus.

It is still a further object to provide a developing cartridge for an image forming apparatus not exposing leaked toner to a user's eyes.

It is yet a further object to provide a developing cartridge for an image forming apparatus that facilitates the elimination of paper jamming.

To achieve these and other objects, the present invention provides a developing cartridge contemplating: a frame, a photosensitive drum which is rotatably installed upon the frame, a developing unit for developing an electrostatic latent image formed on the outer surface of the photosensitive drum, and a transfer unit which is combined with the frame for transferring a toner image from the outer surface of the photosensitive drum onto paper. The present invention provides a developing cartridge comprising: a frame, a photosensitive drum which is rotatably installed upon the frame, a developing unit for developing an electrostatic latent image formed on the outer surface of the photosensitive drum, and a transfer unit which is combined with the frame for transferring a toner image from the outer surface of the photosensitive drum onto paper, and rotary means for enabling the transfer unit to engage the outer surface of the photosensitive drum after the developing carriage is fully installed within the image forming apparatus.

BRIEF DESCRIPTION OF THE DRAWINGS

A more complete appreciation of the present invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
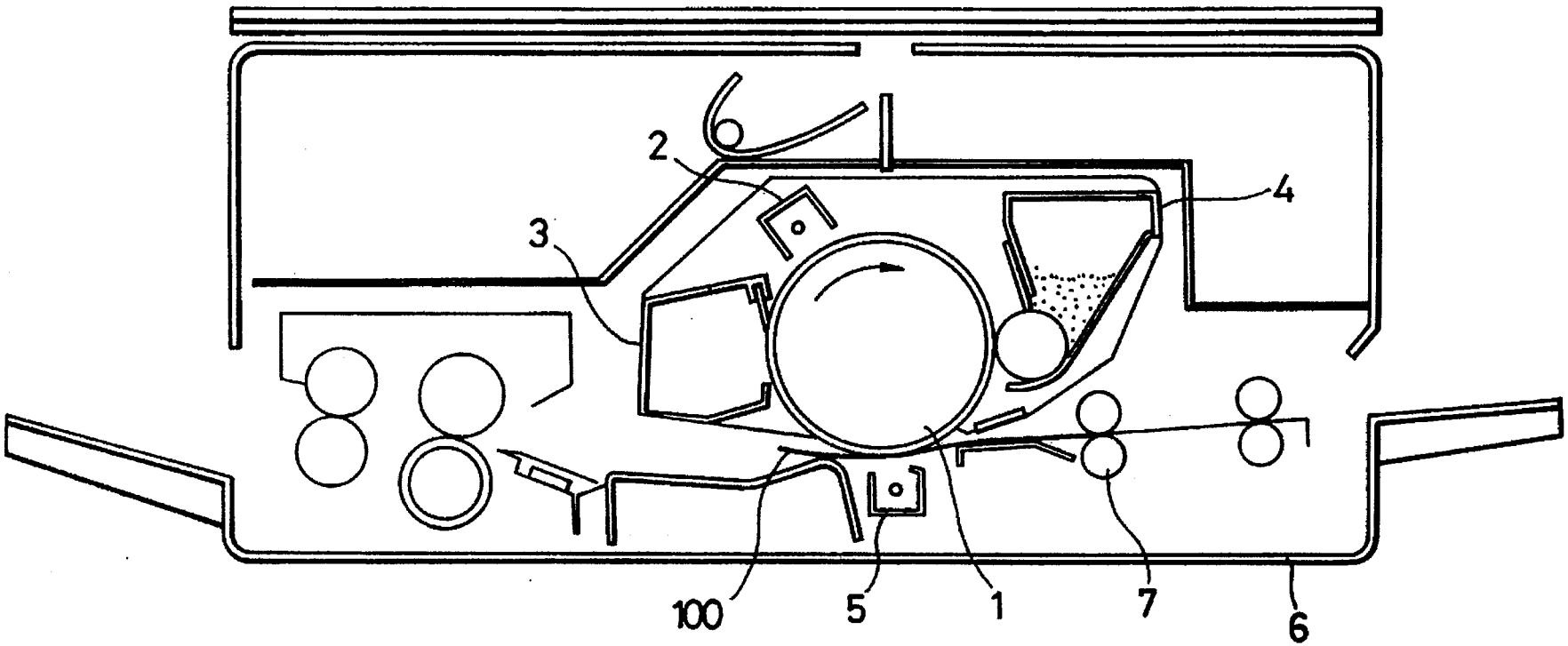
FIG. 1 is a sectional view showing an abstract representation of a conventional image forming apparatus.

Turning now to the drawings and referring to FIG. 1, an abstract representation of a conventional image forming apparatus performing electrophotography is shown. The conventional image forming apparatus of FIG. 1 includes: a photosensitive drum 1, a charging unit 2, a cleaning unit 3 and a developing unit 4 are united into one cartridge and a transfer unit 5 for transferring the developed image to photosensitive dram 1 is installed in a main body 6. With reference to FIG. 1, the process in which an image is formed onto paper will now be described.

To form an image, an electrical charge is first deposited on the outer surface of photosensitive drum 1 by a corona discharge of the charged portion of photosensitive dram 1. Then, when charging unit 2 reaches an exposing unit (not shown) by the rotation of photosensitive drum 1, the charged portion of photosensitive dram 1 is exposed by the exposing unit. As a result, an electrostatic latent image is formed on the outer surface of photosensitive drum 1. The formed latent image then moves to developing unit 4 by the rotation of photosensitive drum 1 and the latent image formed on photosensitive drum 1 is changed into a visible image by developing unit 4 as the toner is deposited onto the outer surface of photosensitive drum 1. As photosensitive drum 1 continues to rotate, the visible image is moved to transfer unit 5. The toner is then transferred onto paper 100 by an electrostatic force between the toner on the outer surface of photosensitive drum 1 and electrical charges accumulated on the back of paper 100 while the paper 100 passes between photosensitive drum 1 and transfer unit 5 as it is fed by conveyance roller 7.

In the image forming process described above, it is of utmost importance that the visible image formed on the outer surface of photosensitive drum 1 be properly transferred onto paper 100 since image resolution ultimately depends on this step. Accordingly, proper function of transfer unit 5 is a paramount concern. The transfer unit 5 of the conventional image forming apparatus typically uses a corotron method, roller method or fibrous brush method. The corotron method and fibrous brush method move the toner with an electrostatic force; that is, toner on the outer surface of photosensitive drum 1 is moved to the paper 100 by a strong positive voltage. With the roller method, toner is transferred onto the paper by a mechanical and electrical force.

According to the structure of the conventional image forming apparatus in which photosensitive drum 1, charging unit 2 and developing unit 4 are united into a single cartridge, transfer unit 5 and photosensitive drum 1 should contact each other along the paper path when the cartridge is combined with main body 6 of the image forming apparatus. Accordingly, them am many restrictions with the arrangement of the cartridge. Also, when the developing cartridge is removed, users may be exposed to toner leaked from the developing cartridge to the transfer unit.

Figure 2:
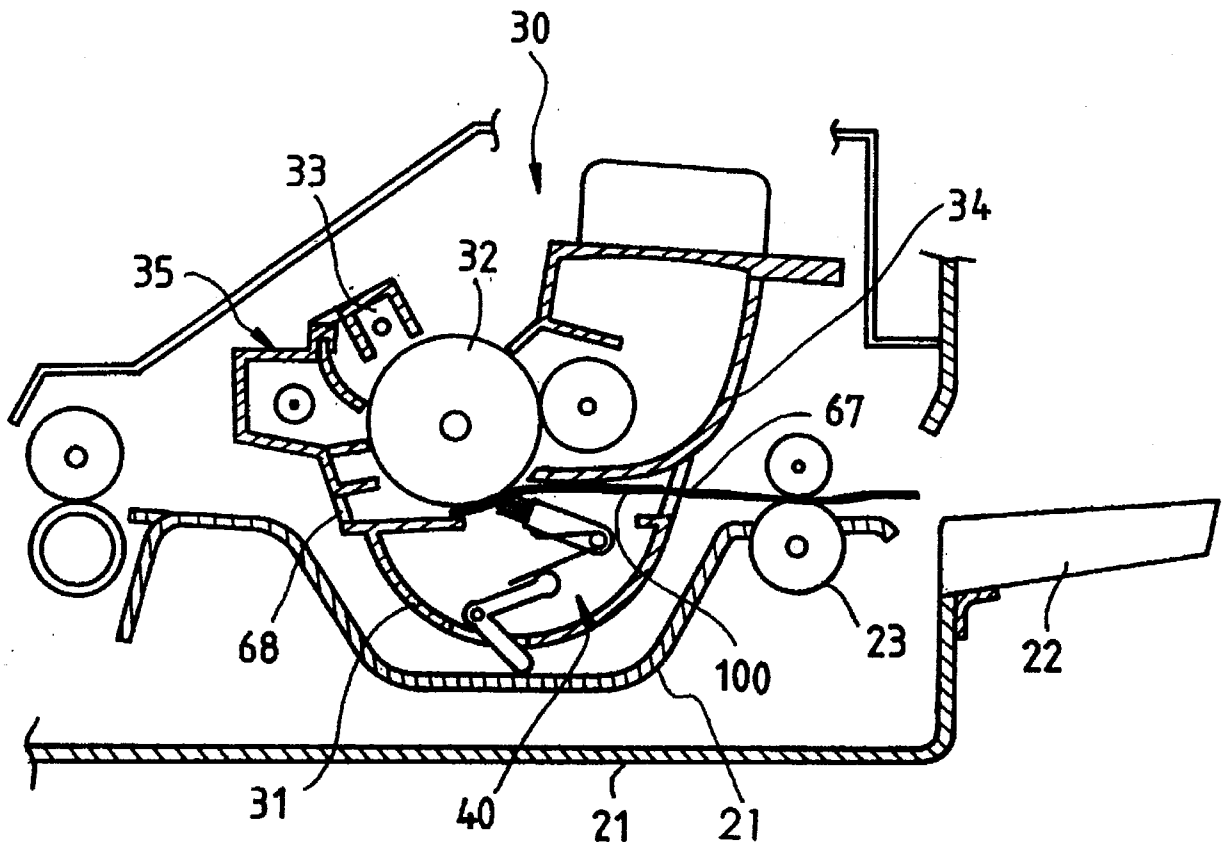
FIG. 2 is a sectional view schematically showing an image forming apparatus constructed according to the principles of the present invention.

Referring now to FIG. 2, an image forming apparatus constructed according to the principles of the present invention is shown. The image forming apparatus of FIG. 2 comprises a main body 21, a paper feeding tray 22 installed on one side of main body 21 to feed paper, a conveyance roller 23 for arranging and conveying the paper 100 fed from paper feeding tray 22, and a developing cartridge 30 installed along the path of paper 100, wherein developing cartridge 30 can be combined with and separated from main body 21.

Developing cartridge 30 includes a photosensitive drum 32 that is rotatably installed on a frame 31 which supports photosensitive drum 32. Developing cartridge 30 further includes: a charging unit 33 for electrically charging the outer surface of photosensitive drum 32, a developing unit 34 for applying toner to the electrostatic latent image formed on the outer surface of photosensitive drum 32, a transfer unit 40 for transferring the toner image formed on the outer surface of photosensitive drum 32 onto paper 100, and a cleaning unit 35 for removing foreign matter from the outer surface of photosensitive drum 32 after the toner has been transferred onto paper 100. In FIG. 2, a brush having fibers is used as a transfer unit.

Figure 3:
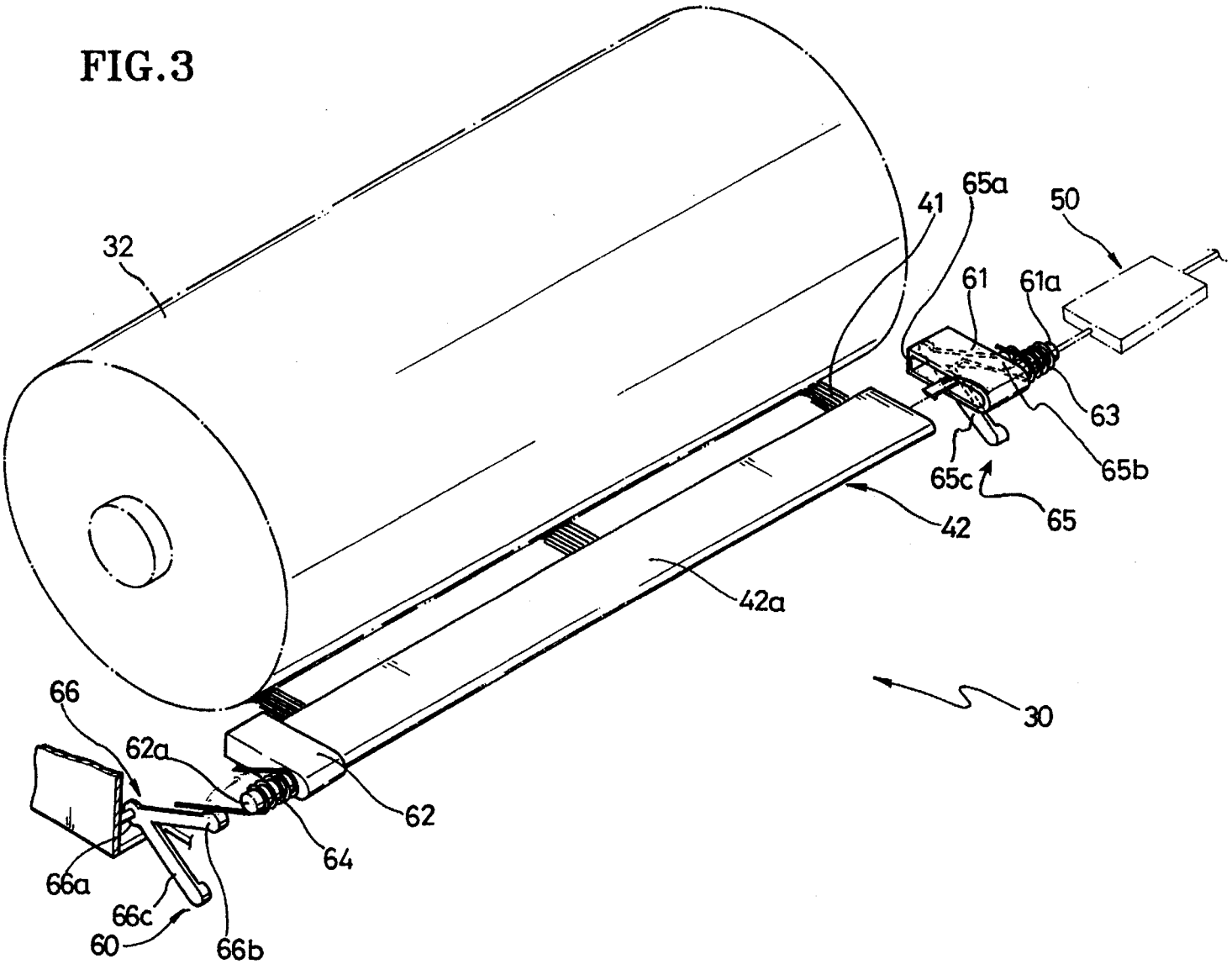
FIG. 3 is an extracted perspective view of the transfer unit of the developing cartridge shown in FIG. 2.

As shown in FIGS. 2 and 3, transfer unit 40 is incorporated into developing cartridge 30 and is comprised of a brush 42 having fibers 41 capable of engaging the outer surface of photosensitive drum 32, and a rotary unit 60 for enabling fibers 41 of brush 42 to move towards and away from the outer surface of photosensitive drum 32. A voltage unit 50 selectively applies a predetermined voltage to brush 42.

It is preferable that fibers 41 of brush 42 be made of nylon or rayon with an electrical resistance of about $10^7$ to $10^8$ Ω. A main body 42*a* of brush 42, from which fibers 41 extend, is preferably composed of a conductive metal. The length of fibers 41 is approximately 2 to 3 centimeters, and a contact angle between fibers 41 and the outer surface of photosensitive drum 32 is preferably 30° to 35° with respect to the horizontal plane.

Voltage unit 50 for applying voltage to brush 42 is composed of a general circuit capable of applying a direct current voltage of 1 to 1.5 kilovolts to brush 42 during transfer periods, and a voltage of −400 to 500 Volts during non-transfer periods.

Rotary unit 60, which rotates to move fibers 41 of brush 42 towards or away from the outer surface of photosensitive drum 32, is installed on both sides of main body 42*a* of brush 42. Rotary unit 60 comprises holders 61 and 62 connected to respective ends of main body 42*a* of brush 42, rotary shafts 61*a* and 62*a* rotatably supported by frame 31 of developing cartridge 30, and torsion springs 63 and 64 respectively supported by rotary shafts 61*a* and 62*a*.

Rotary unit 60 further comprises rotary levers 65 and 66 respectively having hinge portions 65*a* and 66*a* that are rotatably installed with respect to frame 31 of developing cartridge 30. Rotary levers 65 and 66 also include supporting portions 65*b* and 66*b* that respectively engage ends of torsion springs 63 and 64, and protruding portions 65*c* and 66*c* that protrude downwardly through frame 31 of developing cartridge 30 and form a predetermined angle with respect to supporting portions 65*b* and 66*b*. Rotary levers 65 and 66 rotate in response to protruding portions 65*c* and 66*c* engaging main body 21 of the image forming apparatus when developing cartridge 30 is installed within main body 21 of the image forming apparatus.

Developing cartridge 30 includes a paper inlet 67 that guides paper 100 provided from conveying roller 23 to the gap between the outer surface of photosensitive drum 32 and fibers 41 of brush 42, and a paper outlet 68 that guides the paper 100 as it is ejected from developing cartridge 30 after toner has been transferred onto the paper 100.

The operation of the image forming apparatus constructed according to the principles of the present invention will now be described.

To form an image using the image forming apparatus of the present invention, electrical charges are first applied to the outer surface of photosensitive drum 32 by charging unit 33 and the charged portion of photosensitive drum 32 is exposed when the charged portion reaches an exposing unit (not shown) by the rotation of photosensitive drum 32. As a result, the charged portion of the outer surface of photosensitive drum 32 becomes an electrostatic latent image, and later becomes a visible image after toner is applied to the outer surface of photosensitive drum 32 by developing unit 34. As photosensitive drum 32 continues to rotate, the visible image is transferred onto the paper inserted via paper inlet 67 formed in the side of developing cartridge 30 by transfer unit 40.

Figure 4:
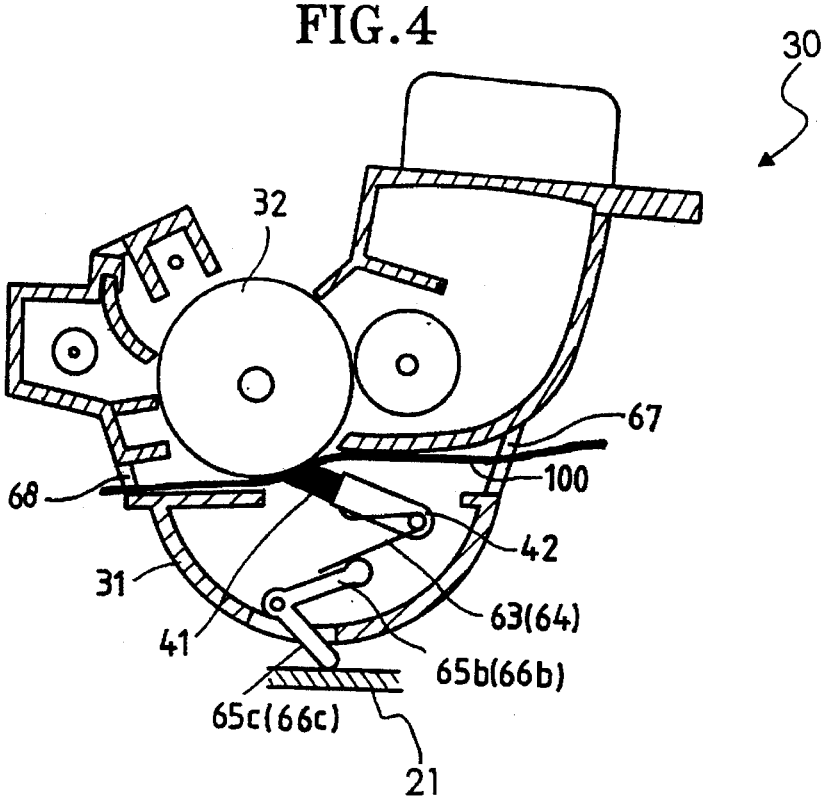
FIGS. 4 and 5 are sectional views showing the operation of the transfer unit.
Figure 5:
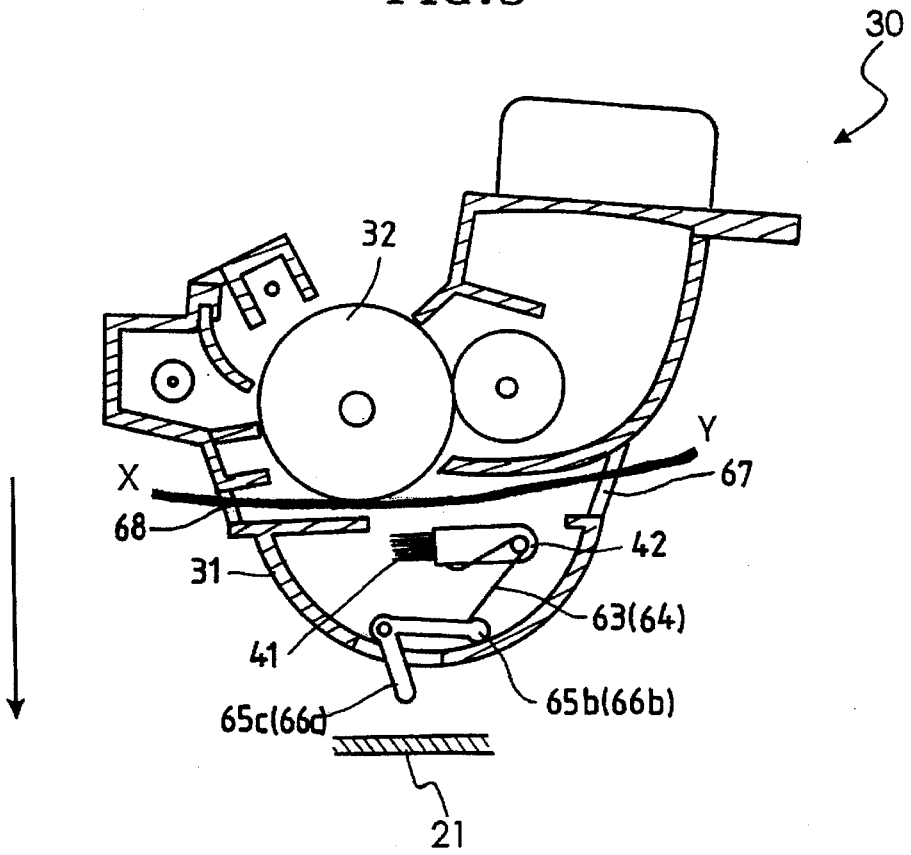

As indicated in FIGS. 4 and 5, protruding portions 65*c* and 66*c* that extend downwardly are moved upwardly as developing cartridge 30 is installed within main body 21 of the image forming apparatus. That is, as developing cartridge 30 is lowered within main body 21 (as indicated by the arrow in FIG. 5), rotary levers 65 and 66 rotate after protruding portions 65*c* and 66*c* engage main body 21 so that supporting portions 65*b* and 66*b* engage torsion springs 63 and 64 and rotate brush 42 upwardly. As a result, fibers 41 of brush 42 engage the outer surface of photosensitive drum 32 (as indicated in FIG. 4).

The transfer operation in which the visible image is transferred onto the paper 100 by transfer unit 40 will now be described.

When paper 100 passes between fibers 41 of brush 42 and photosensitive drum 32 while the visible image is formed on the outer surface of photosensitive drum 32, voltage unit 50 applies a voltage of 1 to 1.5 kilovolts to main body 42*a* of brush 42. As a result, electrical charges are deposited on the side of paper 100 that contacts fibers 41 so that the visible image formed on the outer surface of photosensitive dram 32 is transferred onto the paper 100. When the transfer of toner is complete, a voltage of −400 to 500 volts is applied to brush 42 to prevent the toner on the outer surface of photosensitive drum 32 from being transferred to fibers 41 of brush 42 by an electrostatic force.

As shown in FIG. 5, before developing unit 30 is fully installed within main body 21 of the image forming apparatus, rotary levers 65 and 66 do not rotate upwardly and fibers 41 of brush 42 are not in contact with the outer surface of photosensitive drum 32. If a paper jam occurs, the jammed paper is easily removed via the X or Y (see, FIG. 5) because the transfer unit, i.e., brush, is rotatably downwards. As shown in FIG. 4, however, after developing cartridge 30 is fully installed within main body 21 of the image forming apparatus, protruding portions 65*c* and 66*c* engage main body 21 so that rotary levers 65 and 66 rotate upwardly from the influence of gravity upon developing cartridge 30. Accordingly, torsion springs 63 and 64 are displaced to rotate brush 42 upwardly so that fibers 41 of brush 42 engage the outer surface of photosensitive drum 32.

According to the principles of the present invention described above, transfer unit 40 is incorporated within developing cartridge 30 to provide for an improved toner transfer operation. Moreover, transfer unit 40 selectively engages the outer surface of photosensitive drum 32 depending on whether developing cartridge is fully installed within main body 21 of the image forming apparatus. According to this novel design, an image dispersing effect caused by an uneven electrostatic force can be prevented, the leaked toner in the transfer unit is not exposed to users, and paper jamming can be easily prevented.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A developing cartridge, comprising:

a photosensitive drum;

a developing unit for providing toner to an electrostatic latent image formed on an outer surface of said photosensitive drum to generate a toner image; and a transfer unit comprised of a brush having a main body with fibers extending from said main body for transferring said toner image from said outer surface of said photosensitive drum onto paper as said paper passes between said transfer unit and said photosensitive drum, said photosensitive drum, said developing unit and said transfer unit being combined as a unitary structure, said main body rotating in a first direction and enabling said fibers to engage said outer surface of said photosensitive drum in response to installation of said developing cartridge within an image forming apparatus.

2. A developing cartridge for an image forming apparatus, comprising:

a frame;

a photosensitive drum rotatably installed upon said frame;

a developing unit for providing toner to an electrostatic latent image formed on an outer surface of said photosensitive drum to generate a toner image;

a transfer unit for transferring said toner image from said outer surface of said photosensitive drum onto paper as said paper passes between said transfer unit and said photosensitive drum; and rotary means for providing rotation of said transfer unit in response to installation of said developing cartridge within said image forming apparatus.

3. The developing cartridge as claimed in claim 2, wherein said transfer unit comprises a brush having a main body with fibers extending from said main body.

4. The developing cartridge as claimed in claim 3, wherein said fibers of said brush are comprised of one of nylon and rayon.

5. The developing cartridge as claimed in claim 3, wherein said rotary means comprises:

holding means positioned on first and second ends of said main body of said brush for holding said brush;

shaft means extending outwardly from said holding means on said first and second ends of said main body of said brush for providing an axis upon which said brush rotates; and rotary lever means extending downwardly from said frame to engage a main body of said image forming apparatus and enable rotation of said brush in response to installation of said developing cartridge within said image forming apparatus.

6. The developing cartridge as claimed in claim 5, wherein said rotary means further comprises torsion springs positioned on said shaft means for engaging said rotary lever means and said holding means, said torsion springs enabling the rotation of said brush in response to said rotary lever means rotating as said rotary lever means engages said main body of said image forming apparatus during installation of said developing cartridge within said image forming apparatus.

7. The developing cartridge as claimed in claim 3, wherein said fibers of said brush engage said outer surface of said photosensitive drum at a predetermined angle.

8. The developing cartridge as claimed in claim 7, wherein said predetermined angle is within a range from 30 degrees to 35 degrees.

9. A developing cartridge capable of being installed within and removed from a main body of an image forming apparatus, said developing cartridge comprising:

a frame;

a photosensitive drum rotatably installed upon said frame;

a developing unit for providing toner to an electrostatic latent image formed on an outer surface of said photosensitive drum to generate a toner image; and a transfer unit for transferring said toner image from said outer surface of said photosensitive drum onto paper as said paper passes between said transfer unit and said photosensitive drum, said transfer unit comprising:

a brush having a main body with fibers extending from said main body, said brush rotating to enable said fibers to engage said outer surface of said photosensitive drum in response to installation of said developing cartridge within said image forming apparatus; and rotary means extending downwardly from said frame for engaging said main body of said image forming apparatus and enabling rotation of said brush in response to installation of said developing cartridge within said image forming apparatus.

10. The developing cartridge as claimed in claim 9, wherein said fibers of said brush are comprised of one of nylon and rayon.

11. The developing cartridge as claimed in claim 9, wherein said rotary means comprises:

holding means positioned on first and second ends of said main body of said brush for holding said brush;

shaft means extending outwardly from said holding means on said first and second ends of said main body of said brush for providing an axis upon which said brush rotates; and rotary lever means extending downwardly from said frame to engage a main body of said image forming apparatus and enable rotation of said brush in response to installation of said developing cartridge within said image forming apparatus.

12. The developing cartridge as claimed in claim 11, wherein said rotary means further comprises torsion springs positioned on said shaft means for engaging said rotary lever means and said holding means, said torsion springs enabling the rotation of said brush in response to said rotary lever means rotating as said rotary lever means engages said main body of said image forming apparatus during installation of said developing cartridge within said image forming apparatus.

13. The developing cartridge as claimed in claim 9, wherein said fibers of said brush engage said outer surface of said photosensitive dram at a predetermined angle.

14. The developing cartridge as claimed in claim 13, wherein said predetermined angle is within a range from 30 degrees to 35 degrees.

15. The developing cartridge as claimed in claim 14, wherein said rotary means comprises:

holding means positioned on first and second ends of said main body of said brush for holding said brush;

shaft means extending outwardly from said holding means on said first and second ends of said main body of said brush for providing an axis upon which said brush rotates; and rotary lever means extending downwardly from said frame to engage a main body of said image forming apparatus and enable rotation of said brush in response to installation of said developing cartridge within said image forming apparatus.

16. The developing cartridge as claimed in claim 15, wherein said rotary means further comprises torsion springs positioned on said shaft means for engaging said rotary lever means and said holding means, said torsion springs enabling the rotation of said brush in response to said rotary lever means rotating as said rotary lever means engages said main body of said image forming apparatus during installation of said developing cartridge within said image forming apparatus.

17. A developing cartridge for an image forming apparatus, comprising:

a photosensitive drum;

a developing unit for providing toner to an electrostatic latent image formed on an outer surface of said photosensitive drum to generate a toner image;

a brush having a main body with fibers extending from said main body for transferring said toner image from said outer surface of said photosensitive drum onto a printable medium as the printable medium passes between said brush and said photosensitive drum; and a rotary unit for enabling rotation of said main body of said brush and causing said fibers to engage said outer surface of said photosensitive drum in response to installation of said developing cartridge within said image forming apparatus.

18. The developing cartridge as claimed in claim 17, wherein said rotary unit comprises portions that engage an interior surface of said image forming apparatus and cause the rotation of said main body in response to the installation of said developing cartridge within said image forming apparatus.

19. The developing cartridge as claimed in claim 18, wherein said fibers of said brush are comprised of one of nylon and rayon.

20. The developing cartridge as claimed in claim 19, wherein said fibers of said brush engage said outer surface of said photosensitive drum at a predetermined angle.

21. The developing cartridge as claimed in claim 20, wherein said predetermined angle is within a range from 30 degrees to 35 degrees.

* * * * *